US012024349B2

(12) United States Patent
Alayon Rivera et al.

(10) Patent No.: US 12,024,349 B2
(45) Date of Patent: Jul. 2, 2024

(54) CONNECTABLE CONTACT LENS PACKAGES FOR RECYCLING

(71) Applicant: CooperVision International Limited, Fareham (GB)

(72) Inventors: Javier E. Alayon Rivera, Juana Diaz, PR (US); Jose A. Burgos Cruz, Coamo, PR (US); Jesus Javier Rivera Velez, Juana Diaz, PR (US); Lucas Sievens Figueroa, San Juan, PR (US)

(73) Assignee: COOPERVISION INTERNATIONAL LIMITED, Fareham (GB)

( * ) Notice: Subject to any disclaimer, the term of this patent is extended or adjusted under 35 U.S.C. 154(b) by 0 days.

(21) Appl. No.: 18/385,402

(22) Filed: Oct. 31, 2023

(65) Prior Publication Data

US 2024/0059470 A1 Feb. 22, 2024

Related U.S. Application Data

(62) Division of application No. 17/868,811, filed on Jul. 20, 2022, now Pat. No. 11,834,245.

(Continued)

(51) Int. Cl.
*B65D 75/36* (2006.01)
*B65D 21/02* (2006.01)

(Continued)

(52) U.S. Cl.
CPC ..... *B65D 75/367* (2013.01); *B65D 21/0233* (2013.01); *B65D 65/38* (2013.01);

(Continued)

(58) Field of Classification Search
CPC .. B65D 75/367; B65D 21/0233; B65D 65/38; B65D 85/54; B65D 2565/385; B65D 2585/545

(Continued)

(56) References Cited

U.S. PATENT DOCUMENTS 4,691,820 A 9/1987 Martinez
5,407,062 A * 4/1995 Shannon ..... B29D 11/00125 134/901

(Continued)

FOREIGN PATENT DOCUMENTS

CN 105522664 A 4/2016
EP 1092645 A1 4/2001

(Continued)

OTHER PUBLICATIONS

Search Report issued in corresponding United Kingdom Patent Application GB2313523.9 issued Dec. 1, 2023 (3 pages).

(Continued)

*Primary Examiner* — Jacob K Ackun
(74) *Attorney, Agent, or Firm* — Kilyk & Bowersox, P.L.L.C.

(57) ABSTRACT

Contact lens packages are provided and each includes a base member having a cavity and a sealing member coupled to the base member. An unworn contact lens is provided in a packaging solution within the sealed cavity. The base member is a thermoplastic or other recyclable material. The base member includes at least one latch and at least one slot. The latch and slot are configured to connect to the slot and latch, respectively, of another base member, after the contact lenses are removed from the cavities. A recyclable thermoplastic contact lens assembly is also provided that includes empty contact lens package base members stacked and connected together. A method to recycle used contact lens package base members, such as by curbside recycling, is also provided.

10 Claims, 9 Drawing Sheets

Related U.S. Application Data

(60) Provisional application No. 63/225,976, filed on Jul. 27, 2021.

(51) Int. Cl.
*B65D 65/38* (2006.01)
*B65D 85/00* (2006.01)

(52) U.S. Cl.
CPC ..... *B65D 85/54* (2013.01); *B65D 2565/385* (2013.01); *B65D 2585/545* (2013.01)

(58) Field of Classification Search
USPC ..... 206/1.5
See application file for complete search history.

(56) References Cited

U.S. PATENT DOCUMENTS

| | | | | |
|---|---|---|---|---|
| 5,467,868 | A | | 11/1995 | Abrams et al. |
| 5,609,246 | A | | 3/1997 | Borghorst et al. |
| 5,620,087 | A | | 4/1997 | Martin et al. |
| 5,620,088 | A | | 4/1997 | Martin et al. |
| 5,685,420 | A | | 11/1997 | Martin et al. |
| 5,722,536 | A | | 3/1998 | Pierce et al. |
| 5,993,755 | A | * | 11/1999 | Andersen ..... G02C 13/008 422/292 |
| 6,398,018 | B1 | | 6/2002 | Livesley et al. |
| 6,471,052 | B2 | | 10/2002 | Faxe et al. |
| 6,474,465 | B1 | | 11/2002 | Jux |
| 7,188,729 | B2 | | 3/2007 | DeJonge |
| D543,103 | S | | 5/2007 | Roche et al. |
| 7,213,382 | B2 | | 5/2007 | Voss et al. |
| 7,426,993 | B2 | | 9/2008 | Coldrey et al. |
| 7,477,366 | B2 | | 1/2009 | Clements et al. |
| 7,789,223 | B2 | | 9/2010 | Tokarski et al. |
| 8,069,979 | B2 | | 12/2011 | Newman et al. |
| 9,173,463 | B2 | | 11/2015 | Clamp et al. |
| 9,655,423 | B1 | | 5/2017 | Wang |
| 10,159,625 | B2 | | 12/2018 | Sowden et al. |
| 10,390,593 | B2 | | 8/2019 | English et al. |
| 11,511,909 | B1 | | 11/2022 | Rivera Velez et al. |
| 11,655,070 | B2 | | 5/2023 | Rivera Velez et al. |
| 11,834,245 | B2 | * | 12/2023 | Alayon Rivera .... B65D 75/326 |
| 2005/0247580 | A1 | | 11/2005 | Hamilton |
| 2007/0034533 | A1 | | 2/2007 | Coldrey et al. |
| 2016/0015139 | A1 | | 1/2016 | Clamp et al. |
| 2019/0039798 | A1 | | 2/2019 | Davis |
| 2020/0059469 | A1 | | 2/2020 | Chellappa et al. |
| 2020/0059471 | A1 | | 2/2020 | Farrell et al. |
| 2020/0229560 | A1 | | 7/2020 | Almond et al. |
| 2020/0229563 | A1 | | 7/2020 | Almond et al. |
| 2020/0231351 | A1 | | 7/2020 | Almond et al. |
| 2021/0394986 | A1 | | 12/2021 | Ellis et al. |
| 2023/0033723 | A1 | | 2/2023 | Alayon Rivera et al. |
| 2023/0040022 | A1 | | 2/2023 | Rivera Velez et al. |
| 2023/0249874 | A1 | | 8/2023 | Rivera Velez et al. |

FOREIGN PATENT DOCUMENTS

| | | | |
|---|---|---|---|
| EP | 1799585 | B1 | 7/2010 |
| EP | 2526808 | B1 | 10/2015 |
| GB | 2520297 | A | 5/2015 |
| GB | 2605721 | A | 10/2022 |
| GB | 2614625 | A | 7/2023 |
| JP | 2006016049 | A | 1/2006 |
| JP | 5184925 | B2 | 4/2013 |
| KR | 101907956 | B1 | 10/2018 |
| WO | 9821995 | A1 | 5/1998 |
| WO | 2005073105 | A2 | 8/2005 |
| WO | 2014185354 | A1 | 11/2014 |

OTHER PUBLICATIONS

Contact Lens and Packaging Recycling, www.binyonvision.com/2018/05/10/contact-lens-and-packaging-recycling/, Mar. 12, 2021 (3 pages).

International Search Report and Written Opinion issued in corresponding International Patent Application No. PCT/GB2022/051883 mailed Oct. 18, 2022 (15 pages).

Combined Search and Examination report issued in corresponding United Kingdom Patent Application No. 2210611.6 dated Jan. 13, 2023 (6 pages).

* cited by examiner

CONNECTABLE CONTACT LENS PACKAGES FOR RECYCLING

This application is a divisional of U.S. patent application Ser. No. 17/868,811, filed Jul. 20, 2022, which in turn claims the benefit under 35 U.S.C. § 119(e) of prior U.S. Provisional Patent Application No. 63/225,976, filed Jul. 27, 2021, which is incorporated in its entirety by reference herein.

FIELD

The present invention relates to contact lens packaging and the recycling of at least parts of the packaging. More particularly, the present invention relates to contact lens packages and methods to recycle at least a plurality of base members of such packages after they are used.

BACKGROUND

Newly manufactured contact lenses are frequently packaged in contact lens blister packages or blister packs. For example, a newly manufactured contact lens will be placed in a cavity or bowl of a plastic base member of a contact lens blister package, a contact lens packaging solution will be provided in the blister package cavity, and a foil sealing member will be adhered to the top surface of the base member to hermetically seal the contact lens and packaging solution, in the cavity. In other words, a contact lens blister package contains a base member having a cavity, an unworn contact lens provided in packaging solution within the cavity, and a sealing member sealed to the base member to provide an air tight seal around the perimeter of the cavity.

Base members of blister packages are generally formed of a plastic or thermoplastic material. It is common for a user to peel away the sealing member, take the unworn contact lens out of the cavity, and discard the empty blister package, or the plastic base member, in the trash such that it is not recycled. Each individual blister package, or plastic base member, is too small to be recycled as plastic at most recycling centers because most recycling processes for plastic require minimum dimensions of the plastic to be recycled. If such dimensions are not met, most recycling processing lines have steps to remove these smaller objects and avoid recycling them. In other words, objects like individual blister packages are not recycled and instead are treated as non-recyclable trash or waste. The material that the contact lens package is made of, however, is a recyclable material. Accordingly, there is a need to address this problem so that contact lens packaging can be recycled by recycling centers.

It can be appreciated that there remains an important environmental need to improve contact lens packaging, which, among other things, provides the ability to recycle the contact lens packaging or a portion thereof, after use.

SUMMARY

A feature of the present invention is to provide a contact lens wearer with the ability to successfully have the contact lens package (or a portion thereof) accepted as recyclable material at a recycling facility or MRF (Materials Recovery Facility).

An additional feature of the present invention is to provide a method for a contact lens wearer or purchaser to easily recycle contact lens packages or portions thereof (e.g., curbside recycling).

A further feature of the present invention is to provide a contact lens wearer or purchaser a simple way to recycle used or opened contact lens packages, for example, by curbside recycling.

Also, a feature of the present invention is to provide a way to recycle used or opened contact lens packages as a collective unit such that the packages that form the collective unit preferably do not break or separate during transport to and during initial processing steps at a recycling facility.

Additional features and advantages of the present invention will be set forth in part in the description that follows, and in part will be apparent from the description, or may be learned by practice of the present invention. The objectives and other advantages of the present invention will be realized and attained by means of the elements and combinations particularly pointed out in the description and appended claims.

To achieve these and other advantages, and in accordance with the purposes of the present invention, as embodied and broadly described herein, the present invention, in part, relates to a contact lens package base member. The base member includes a planar top surface having an edge and at least partially defining a handle, a bottom surface, and a bowl that is recessed from the planar top surface. The bowl has an upper rim that intersects with the planar top surface, and defines a cavity configured for holding a contact lens. The handle extends away from the bowl and terminates at a handle end. A first slot is formed through the planar top surface, spaced away from the upper rim, and located on a first side of the bowl. A first latch extends downwardly from the planar top surface, adjacent to the first slot. The first latch can be spaced away from the upper rim. A second slot is located on a second side of the bowl, wherein the second side is opposite, that is, across the bowl, from the first side. A second latch extends downwardly, adjacent to the second slot.

The present invention further relates to a plurality of contact lens packages. Each of the plurality of contact lens packages includes a base member that defines a cavity, at least one latch, and at least one slot. The base member of each package comprises a planar top surface surrounding the cavity. The planar top surface provides a sealing surface. Each base member is a thermoplastic material. For each package, a sealing member is coupled to the sealing surface of the base member to provide a sealed cavity. An unworn contact lens, soaking in a contact lens packaging solution, is sealed within the sealed cavity. The at least one latch of a first contact lens package of the plurality is configured to fasten to the at least one slot of a second contact lens package of the plurality, for example, at least after the sealing member of the second contact lens package is removed.

The present invention also relates to a contact lens package. The contact lens package includes a base member made of a thermoplastic material that defines a cavity. The base member has a planar or substantially planar top surface surrounding the cavity. The top surface provides a sealing surface. The base member further includes at least one latch and at least one slot. A sealing member is coupled to the sealing surface of the base member to provide a sealed cavity. An unworn contact lens is provided in a contact lens packaging solution, within the sealed cavity. The at least one latch is configured to mechanically fasten with a slot of another contact lens package, and the at least one slot is configured to mechanically fasten to a latch of yet another contact lens package.

The present invention also relates to a method of recycling used contact lens packages. The method enables used contact lens packages, or the base members of used contact lens packages, to be sortable for recycling at recycling facilities or MRFs. The method can include the steps of stacking together a plurality of used contact lens package base members to form a recyclable assembly, and recycling the recyclable assembly. Each of the plurality of used contact lens package base members defines a cavity sized to retain a contact lens therein and comprises a first latch, a second latch, a first slot, and a second slot. Each used contact lens package base member comprises a plastic or thermoplastic material. The used contact lens package base members can be stacked together such that the first latch and the second latch of one base member are received within, and mechanically fastened to, the second and first slots, respectively, of another one of the base members, to form a stack. Once enough base members are stacked together, a recyclable assembly is formed. The recyclable assembly will have dimensions suitable to be accepted by a recycling facility or MRF so that the plastic can be recycled.

It is to be understood that both the foregoing general description and the following detailed description are exemplary and explanatory only and are intended to provide a further explanation of the present invention, as claimed.

The accompanying drawings, though not drawn to scale, exemplify relative dimensions that can be used. The accompanying drawings are incorporated in and constitute a part of this application and illustrate some of the features of the present invention. The drawings, together with the description, serve to explain the principles of the present invention.

DETAILED DESCRIPTION

Figure 1A:
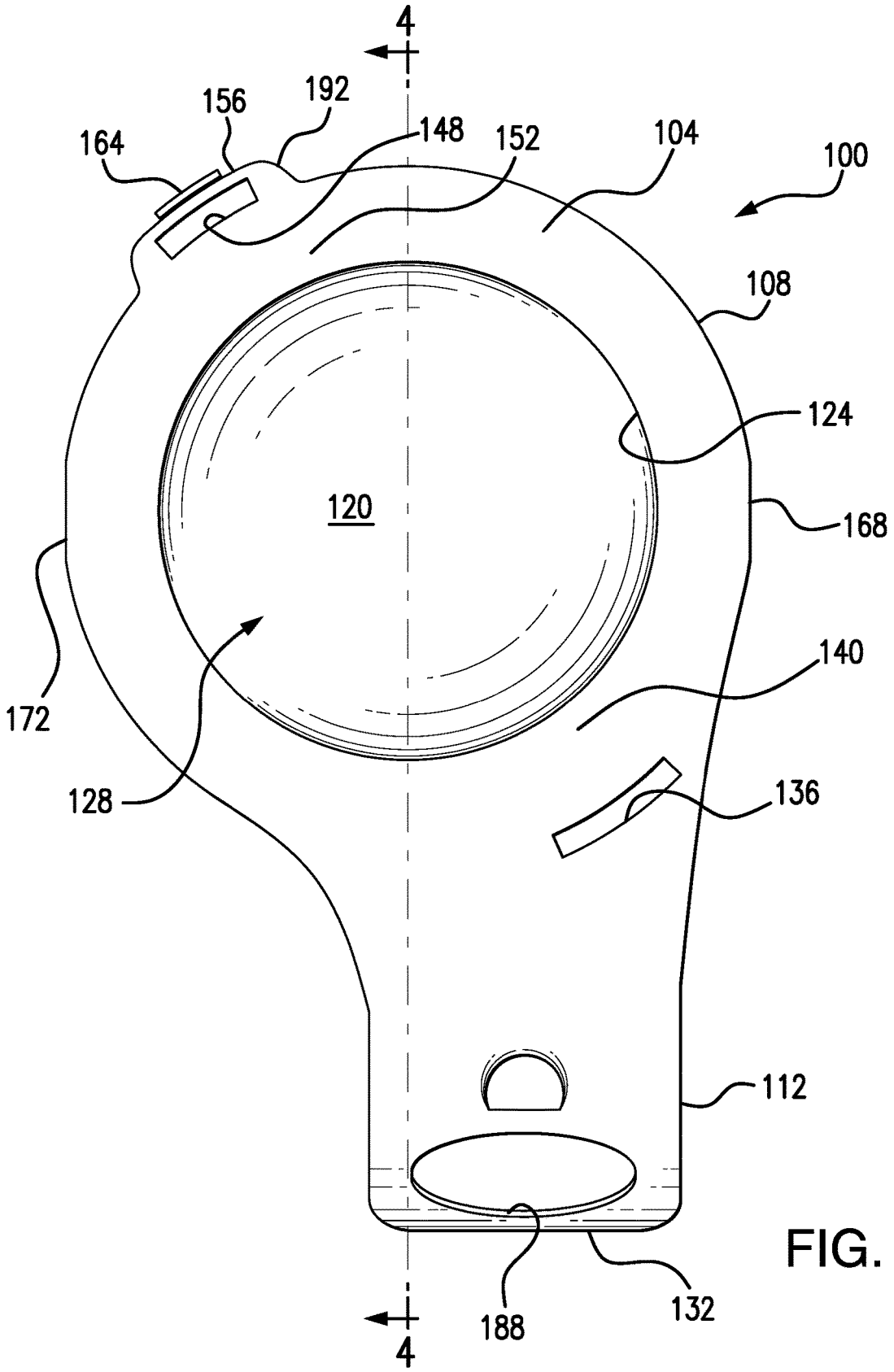
FIG. 1A is a top view of a contact lens package base member according to an exemplary embodiment of the present invention.

The present invention relates to contact lens packages as well as to methods of recycling used contact lens packages or the base members of the contact lens packages. The present invention further relates to a contact lens package base member stack or assembly comprising a collection of used contact lens package base members that are mechanically fastened together. The present invention also relates to methods of attaching used contact lens package base members together to form a recyclable assembly of used contact lens package base members that is suitable as a recyclable material, for example, by exhibiting acceptable dimensions required or requested for recycling.

The present invention enables used contact lens package base members to become sorted, for example, processed, and recycled at recycling facilities such as MRFs. In other words, the present invention enables a user or other person to recycle used or opened contact lens package base members (e.g., blister packages) or portions thereof and enables the user or other person to form a recyclable unit from a plurality of opened or used contact lens package base members (e.g., blister package base members), wherein the unit exhibits dimensions that can be acceptable in size for sorting facilities and withstand the handling/sorting. Thus, with the present invention, recycling, such as curbside recycling, is possible and feasible and easy to accomplish by the contact lens wearer or purchaser.

The present invention provides a contact lens user or another person, with a simple way to recycle opened or used contact lens package base members, for example, by curbside recycling.

In more detail, with respect to the contact lens packages, each of the contact lens packages can include connecting members for connecting the base member or members of one or more other contact lens packages of the plurality, such that the so connected base packages, base members, or both, form a recyclable assembly, unit, or item.

The connecting members as described herein are in the form of a slot(s) and a corresponding latch(es), where the latch of one base member connects with a slot of a second base member to form connected base members from this attachment of the latch into the slot. This attachment is preferably such that the connected members are not easily removed from each other.

As one option, the latch of one base member that fits into the slot of another base member can be dimensioned so that the connection forms an interlocking fit, or pressure fit or interference fit or snug fit between the latch and slot. The width of the distal end of the latch that first enters the slot when connecting can have a width and thickness such that the latch can be put through the slot with either no force or a slight force and thus the one base member is securely attached to the second or adjacent base member and so on, and the connected base members cannot be removed easily (e.g., the base members will not disconnect from each other due to gravity or due to gripping of the connected base members attached to each other). As an example, the slight force can be characterized as at least an amount of force that a person can connect the base member onto the adjacent base member, but that the base members cannot be disconnected or be removed from each other without a greater amount of force than used to attach the base members together.

In the illustrated embodiment, the latch has a thickness that is less than the width of the slot (e.g., from 1% to 15% less or from 1% to 10% less or from 1% to 5% less in thickness compared to the width of the slot). For example, the latch can have a thickness that is from 0.05 mm to 0.4 mm less than the width of the slot. As one example, the latch can have a thickness from 0.1 mm to 0.3 mm less than the width of the slot. In a further example, the latch can have a thickness that is 0.2 mm less than the width of the slot.

Still further, as shown in the accompanying the drawings, the latch may include a barb extending from a surface of the latch. The length of the barb (the distance from which the edge of the barb extends from the latch surface) can be from 0.1 mm to 0.8 mm or other amounts above this range. In a preferred embodiment, the length of the barb and the latch together (as illustrated by D16 in FIG. 5D, for example) is greater than the width of the slot into which the latch is inserted (e.g., from 1% to 15% or more greater or from 1% to 10% greater or from 1% to 5% greater in length compared to the width of the slot). For example, the combined length or distance of the barb and latch can be from 0.1 mm to 0.5 mm greater than the width of the slot. As a further example, the length or distance of the barb and latch can be from 0.15 mm to 0.45 mm greater than the width of the slot. In an additional example, the length or the distance of the barb and the latch is about 0.2 mm greater than the width of the slot. It will be understood that the term "length" of the barb is in the context of the present disclosure, and it can also be understood that this length defines the thickness of the barb or the thickness of the latch and the barb. The thickness should be selected so that the barb can engage an under surface of the base of the blister through the slot.

As an option, when two or more base members are connected together, at least a portion of the exterior bowl surface of one base member nests in the interior bowl surface of the connecting base member. This portion can be at least 5% or from 5% to 90% of the available exterior surface area and/or interior surface area of the bowl, such as from 25% to 70% or from 30% to 60%.

The plurality of contact lens package base members that can be connected together can include two or more, three or more, four or more, five or more, ten or more, twenty or more, thirty or more, sixty or more, or 90 or more. There is no limit to the number of contact lens package base members that can be connected together.

With respect to each of the contact lens packages, each of the packages can independently include or comprise a base member (e.g., plastic base member) comprising at least two connecting features or members. Each pair of connecting members can independently comprise at least one latch, at least one slot, a combination of a latch and a slot, or a combination thereof. Each base member can comprise a bowl that defines a cavity that is configured to retain a contact lens and contact lens packaging solution. A planar top surface, for example, a flange region, can extend outwardly from a top rim of the bowl and cavity. A sealing member or sealing lid can be provided and can comprise a removable foil or lid attached to the planar top surface or flange region to provide a sealed contact lens package, for example, a blister package.

Each of the used base members can connect with one or more others to form the recyclable item. If the sealing members are plastic, then the sealing members can optionally be recycled along with the plastic base members.

Each base member can comprise, consist essentially of, or consist of a thermoplastic material or other recyclable plastic or recyclable plastic material. Each base member can comprise plastic, polyvinylchloride (PVC), polyethylene, polypropylene, polybutylene, polystyrene, a polyalkylene, polyethyleneterephthalate (PET), a combination thereof, or the like. The base member can be made of a material that is recyclable, meaning that the material is of a type that can be taken to a recycle facility or trash facility and put in a recycle bin, such as a plastics recycling bin. The base member can be made of conventional material used for contact lens base members. The base member can be formed from or comprise a polypropylene resin.

The base member can have or include a substantially planar top surface (or flange region) that intersects with an upper rim of the bowl and surrounds the cavity. The planar top surface can intersect with an edge, for example, at a vertical edge. The planar top surface can at least partially define a handle. The substantially planar surface provides a sealing surface for the sealing member. With the sealing member on the planar surface, a sealed cavity is formed. The term "substantially planar" means a planar surface or a surface surrounding the cavity that is at least 80% in surface area, or at least 90% in surface area, or at least 95% in surface area, or at least 99%, or 100% in surface area planar or flat, or a surface area that is very gently concave or convex. By very gently concave or convex what is meant is that the difference in height, when resting on a horizontal surface, between the highest point and the lowest point on the substantially planar top surface, can be no more than about 0.5 centimeter (cm), no more than 0.25 cm, no more than 0.1 cm, or no more than 0.05 cm, or other amounts within or outside of any one or more of these ranges. The base member may also include a raised rim surrounding the cavity of the base member and extending upwardly from the planar top surface. In such embodiments, the raised rim will also have an upper rim surface that is planar, and parallel to the planar top surface of the base member.

The sealing member can be sealed to the base member to create a seal that can withstand autoclaving conditions used to sterilize the unworn contact lenses. Once the seal is broken by separating the sealing member from the base member, the contact lens package is referred to herein as opened.

With respect to the at least one latch, the at least one slot, or both, of each of the base members, as indicated, the latch of one base member is configured to fit inside and mechanically engage (e.g., interlock or connect), with at least one slot of another base member, thus connecting the two base members together. The latches and slots of the base members can be configured, shaped, or designed to connect with other slots and latches and to connect a plurality of contact lens package base members together after the respective contact lenses are removed from the respective cavities.

As an option, each of the base members can include a first slot, a first latch, a second slot, and a second latch. The first slot is formed through the planar top surface, can be spaced away from the upper rim, and can be located on a first side of the bowl. The first latch extends downwardly from the planar top surface and can be adjacent to the first slot. The first latch can be spaced away from the upper rim. The second slot can be located on a second side of the bowl, the second side being opposite the first side. The second latch extends downwardly and can be adjacent to the second slot. The first slot and the first latch of one of the base members can connect with the second latch and the second slot, respectively, of another base member. Including first and second slots and first and second latches strengthens the connection between the interconnected base members.

When more than one slot is present on the planar surface of a base member, the two or more slots can be equally spaced from each other. For instance, the rim of the bowl can be considered to define a circular shape having 360 degrees. When two slots are present, the slots can be 180 degrees apart from each other or within 10 degrees of this spacing. As another option, when two slots are present, the spacing can be less than 180 degrees apart, such as from 50 degrees to 150 degrees apart.

As an option, each of the latches can independently include a distal end, and each distal end can have a tapered side, a tapered edge, a tapered corner, or a combination thereof. For example, each latch can each include a barb or notch or catch shape design to lock or connect with the slot. The slots can be sized to receive the barbs from a first direction, and catch the barbs, preventing the barbs from exiting the slots in a second direction opposite the first direction. The barbs can be malleable, deformable, elastically deformable, tapered, beveled, a combination thereof, or the like.

The slots can have any shape including, but not limited to, circular, rectangular, trapezoid and the shape can be further defined by curved or rounded surfaces as opposed to straight lines and right angles. The slots can each form an open area such that this area is less than 1% of the total surface area of the planar surface of the base member (such as 0.5% or less, 0.25% or less, 0.1% or less or 0.05% or less).

The latches on the base member can have the same or a different dimension and/or shape with respect to each other. The slots on the base member can have the same or different dimension and/or shape with respect to each other. For instance, the first latch is of a first latch dimension and the second latch is of a second, different, corresponding latch dimension. The first slot can be of a first slot dimension and the second slot can be of a second, different, corresponding slot dimension.

The at least one latch and the at least one slot of each of the plurality of contact lens packages can together comprise a poka-yoke design. In such a design, the handle of the first contact lens package can only be capable of extending in a direction that is different than a direction of extension of the handle of an immediately adjacent contact lens package, after the contact lens packages are used or opened and upon stacking together.

More than two latches can be provided on or with each base member. More than two slots can be provided in or through each base member. With multiple latches, multiple slots, or both, different stack arrangements can be made by stacking the used base members together. The respective handles can extend in different directions, for example, in two opposite directions, in two angled directions, in three angled positions, in four angled positions, or in any number of angles relative to the other handles of the other stacked base members. The angular positions can be evenly spaced apart, not evenly spaced apart, randomly spaced apart, spaced apart in a spiral, or the like, all with respect to an axis travelling through the centers of the bowls of the used base members. When in angled directions, the difference in angle for respective handles for two base members connected together (or nested together) can be, for instance, from 10 degrees to 180 degrees, such as 10 degrees, 20 degrees, 30 degrees, 40 degrees, 50 degrees, 60 degrees, 70 degrees, 80 degrees, 90 degrees, 100 degrees, 110 degrees, 120 degrees, 130 degrees, 140 degrees, 150 degrees, 160 degrees, or 170 degrees, or 180 degrees.

As an option, the base members are attachable to one another such that the plurality of empty base members are oriented in either a singled stacked configuration or in an alternating, stacked configuration. The cavities of the empty base members can optionally nest within one another other when the empty base members are attached above and/or below one another. The nesting can result in either the base member cavities contacting each other or not contacting each other. The bowls of the empty base members can optionally be spaced apart from the bowls of one or more immediately adjacent base members.

As an option, the first latch and the first slot are located between the bowl and the handle end and the second latch and the second slot are located on an opposite side of the bowl. Alternatively, the latches and slots can be located in other locations around a periphery of the bowl, on the handle, or at any other location, such that the latches and slots can connect a plurality of empty base members together. The first slot can be located at any location of the planar surface between the rim of the bowl and the end of the planar surface.

As an option, one of two latch-and-slot combinations can be part of an extension that bulges out from an outer edge of the base member. For example, a slotted extension can bulge out from the edge and the slotted extension can define a slot. A latch can extend downwardly from the slotted extension. For instance, with this type of embodiment, a side of the interior edge that forms a portion of the slot can be defined by the edge of the planar surface itself (e.g., as shown by the slot in FIG. 1B, slot 148).

The base members can further include a first vertical sidewall and a second vertical sidewall. The first vertical sidewall can extend downwardly from the edge, can have a first depth, and can be located along the edge between the first latch and the second latch. The second vertical sidewall can extend downwardly from the edge, can have a second depth, and can be located along the edge between the second latch and the first latch. The second vertical sidewall can be located on an opposite side of the bowl relative to the first vertical sidewall. While the vertical sidewall or vertical sidewalls extend downwardly from the edge, the vertical sidewalls may have a slope ranging from seventy degrees to ninety degrees or other slope amounts (where the degrees are with respect to the planar surface) from the surface extending from the planar top surface. Thus, it can be understood that the vertical sidewalls may have an approximately vertical orientation relative to the planar top surface extending from the edge. The bowl can have a depth that is of a greater dimension than the first depth, and the bowl can have a depth that is of a greater dimension than the second depth.

The first and second vertical sidewalls can be located such that they are not adjacent to any slot. Referring again to the 360 degrees that define the rim of the bowl, the vertical sidewalls can be located such that they are 180 degrees away from each other or within 10 degrees of this distance. Referring to the vertical sidewalls and slots on the same base member, the one vertical sidewall can be from about 10 degrees to about 45 degrees away from at least one slot when two slots are present on the base member, such as from about 10 degrees to about 30 degrees. The other vertical sidewall can be similarly distanced from the other slot when present.

The vertical sidewall can have any shape or geometry, such as a rectangle, trapezoid, half circle, and the like, and any shape can have rounded edges or sides. As an option, the depth of the vertical sidewall can be such that when two base members are connected together, the vertical sidewalls can provide or contribute to the connected base members being connected to form a level surface or about a level surface (within 10 degrees or within 5 degrees of being leveled) based on the planar surface of each base member.

The present invention can include a kit that comprises a carton, box, container, or other packaging, also referred to as a carton. The carton can be made from virgin or recycled cardboard, lid stock, compressed paper, paperboard, or the like. A kit in accordance with the present invention can comprise, consist essentially of, or consist of, a carton, and a plurality of sealed contact lens packages (e.g., blister packs) containing sterilized, unworn contact lenses. Each of the plurality of sealed contact lens packages includes one or more of the connecting features or members described herein. In a further embodiment, such a kit comprises ten or more contact lens packages (e.g., blister packs), thirty or more contact lens packages, sixty or more contact lens packages, or ninety or more contact lens packages. The carton can be a box, a bag, a package, a tray, an enclosure, or any other type of container.

Figure 1B:
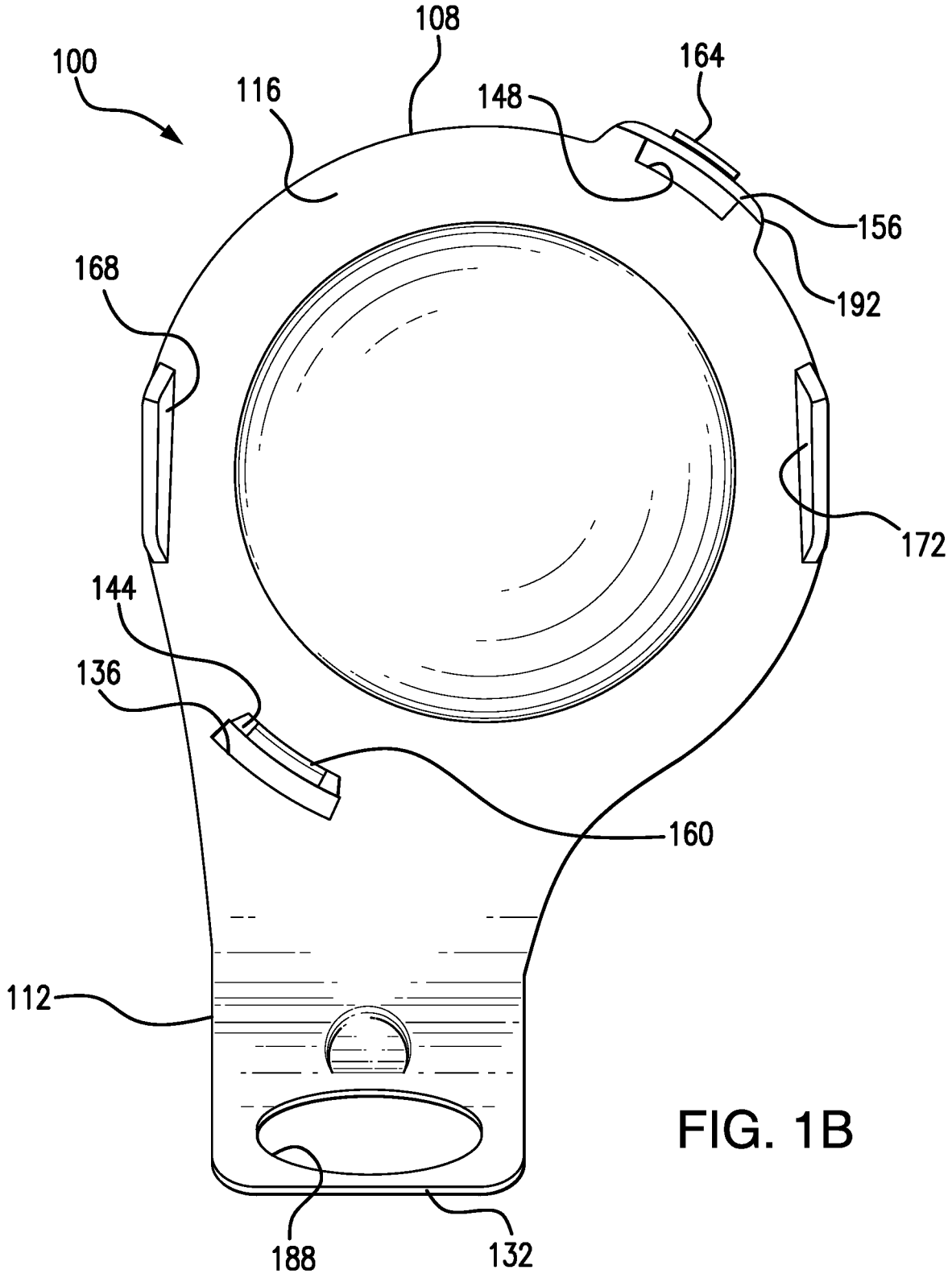
FIG. 1B is a bottom view of the contact lens package base member shown in FIG. 1A.

As shown in FIGS. 1A and 1B, the contact lens package base member 100 comprises a planar top surface 104 having an edge 108 and at least partially defining a handle 112. A bottom surface 116 opposes planar top surface 104. A bowl 120 is provided recessed from planar top surface 104 and has an upper rim 124 that intersects with the planar top surface and defines a cavity 128. Cavity 128 is configured for holding a contact lens, for example, contact lens 408 shown in FIG. 4. Handle 112 extends away from bowl 120 and terminates at a handle end 132. A first slot 136 is formed through planar top surface 104 and is spaced away from upper rim 124. First slot 136 is located on a first side 140 of bowl 120. A first latch 144 extends downwardly from planar top surface 104 and is adjacent to first slot 136. First latch 144 is spaced away from upper rim 124. A second slot 148 is located on a second side 152 of bowl 120. As can be seen, second side 152 is opposite first side 140 of bowl 120. A second latch 156 extends downwardly, adjacent to second slot 148.

Figure 4:
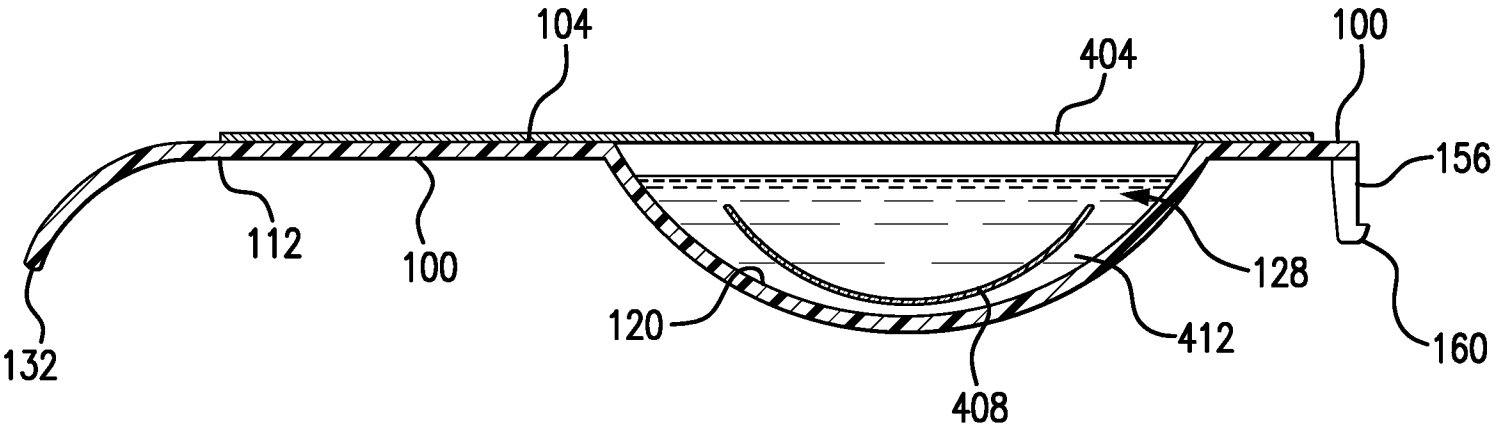
FIG. 4 is a cross-sectional side view of a contact lens package including a sealed base member and a contact lens and contact lens packaging solution contained therein, wherein the base member is the base member shown in FIGS. 1A and 1B.

A sealing member 404, such as a foil seal as shown in FIG. 4, can be sealed or coupled to top planar surface 104 to seal cavity 128. An unworn contact lens 408 can be provided, sealed in cavity 128, along with contact lens packaging solution 412, as shown in FIG. 4.

First latch 144 can comprise a catch mechanism, for example, a first barb 160 as shown. Second slot 148 can be sized to receive first barb 160 from a first direction, and catch first barb 160, preventing it from exiting second slot 148 in a second direction opposite the first direction. First barb 160 can be malleable, deformable, elastically deformable, tapered, beveled, a combination thereof, or the like. Second latch 156 can comprise a catch mechanism, for example, a second barb 164. Second barb 164 can be malleable, deformable, elastically deformable, tapered, beveled, a combination thereof, or the like. First slot 136 can be sized to receive second barb 164 from a first direction, and catch the second barb, preventing it from exiting first slot 136 in a second, opposite direction. First latch 144 and first slot 136 can be located, for example, between bowl 120 and handle end 132. Handle end 132 can curve downwardly from planar top surface 104 and can comprise a thumb grip 188.

Figure 2:
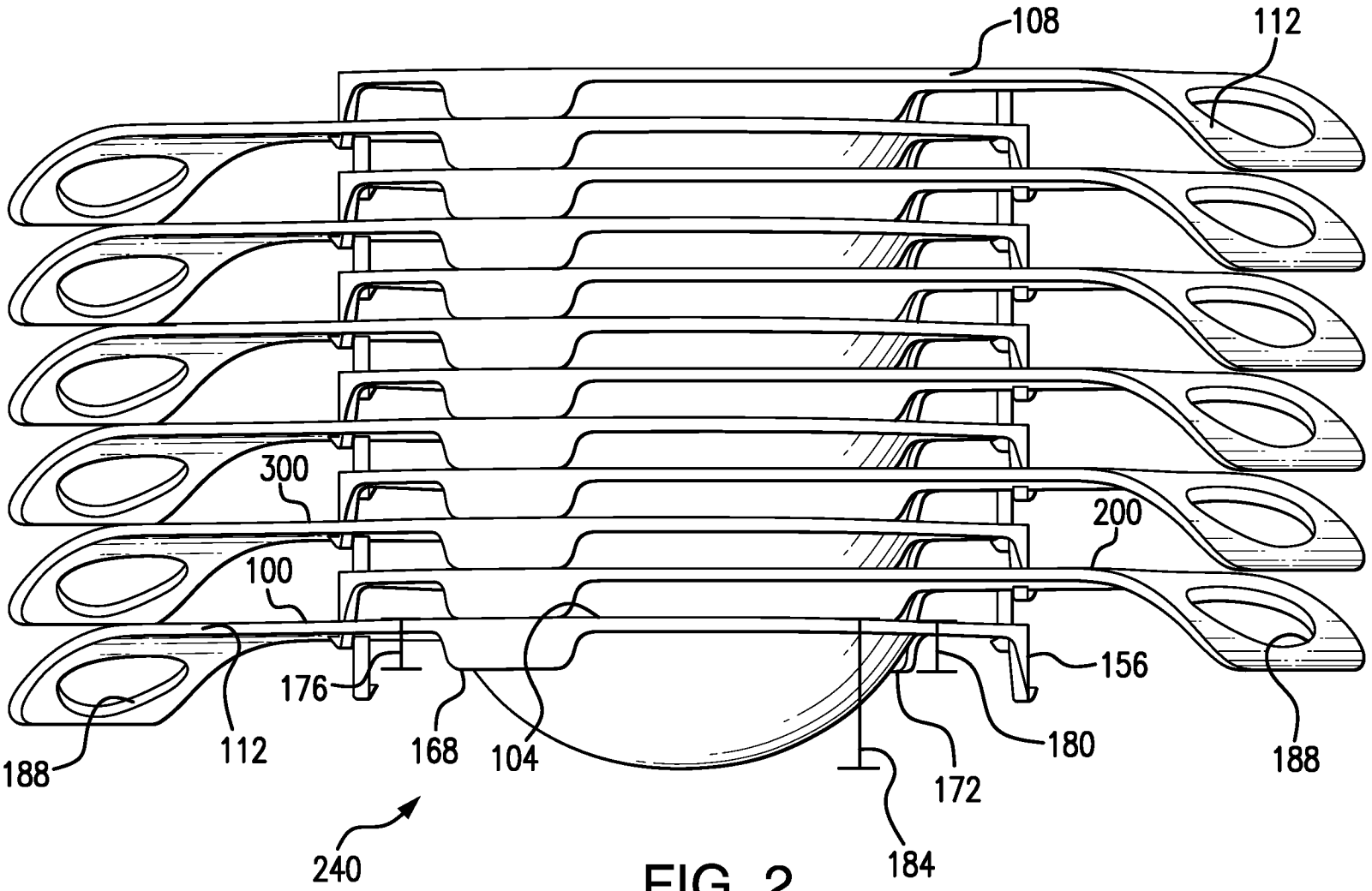
FIG. 2 is a side view of a recyclable assembly of contact lens package base members each of which is individually shown in FIGS. 1A and 1B.

Contact lens package base member 100 can comprise a first vertical sidewall 168, a second vertical sidewall 172, or both. First vertical sidewall 168 and second vertical sidewall 172 can be provided to strengthen base member 100, to prevent base member 100 from tipping over, and/or to prevent over-deformation of bowl 120. The vertical sidewalls can add stability to base members that are connected together. First vertical sidewall 168 can extend downwardly from edge 108 and can have a first depth 176 as shown in FIG. 2, measured from planar top surface 104. First vertical sidewall 168 can be located along edge 108 between first latch 144 and second latch 156. Second vertical sidewall 172 can extend downwardly from edge 108 and can have a second depth 180 measured from planar top surface 104, as shown in FIG. 2. Second vertical sidewall 172 can be located along edge 108 between second latch 156 and first latch 144. Second vertical sidewall 172 can be located on an opposite side of bowl 120, relative to first vertical sidewall 168. Bowl 120 can have a depth 184, measured from planar top surface 104, that is of greater dimension than first depth 176. Bowl 120 can have a depth that is of greater dimension than second depth 180. First depth 176 and second depth 180 can be of the same dimension or of different dimensions relative to one another.

In general, the depth of the vertical sidewalls is such that they will not interfere with the latch of one base member connecting to the slot of a second base member or prevent such a connection. Thus, the depth of the vertical sidewalls is generally dictated in part by the length of the latch(es).

Contact lens package base member 100 can comprise a slotted extension 192 bulging out from edge 108. Slotted extension 192 can define or partially define second slot 148. Second latch 156 can extend downwardly from slotted extension 192.

First latch 144 can be of a first latch dimension and second latch 156 can be of a second, different corresponding latch dimension. First latch 144 and second latch 156 can be of the same dimensions. First slot 136 can be of a first slot dimension and second slot 148 can be of a second, different corresponding slot dimension. First slot 136 and second slot 148 can be of the same dimensions. Each of first latch 144 and second latch 156 can independently comprise a distal end and each distal end can have a tapered side, a tapered edge, a tapered corner, a combination thereof, or the like.

Also provided is a combination of two or more contact lens package base members, for example, a combination of a first used contact lens package base member 100 and a second used contact lens package base member 200, as shown in FIG. 2. The combination can be understood to be a stack or an assembly of contact lens package base members, and if large enough, can be a recyclable assembly. Either or both of the contact lens package base members 100, 200 can be as described above. For example, second contact lens package base member 200 can also have: a planar top surface having an edge and at least partially defining a handle; a bottom surface; a bowl that is recessed from the planar top surface, has an upper rim that intersects with the planar top surface, and defines a cavity configured for holding a contact lens, the handle extending away from the bowl and terminating at a handle end; a first slot formed through the planar top surface, spaced away from the rim, and located on a first side of the bowl; a first latch extending downwardly from the planar top surface and adjacent to the first slot, the first latch being spaced away from the rim; a second slot located on a second side of the bowl, the second side being opposite the first side; and a second latch extending downwardly and adjacent to the second slot. The first latch of second contact lens package base member 200 can be configured to fit into the second slot of first contact lens package base member 100. The second latch of second contact lens package base member 200 can be configured to fit into the first slot of first contact lens package base member 100. As such, the contact lens package base members are stackable and can be stacked together and mechanically engaged to one another. For example, the present invention also provides a combination of second contact lens package base member 200 stacked on top of first contact lens package base member 100 to form a recyclable assembly 240. In recyclable assembly 240, the first and second latches of second contact lens package base member 200 extend through the second and first slots, respectively, of first contact lens package base member 100.

Figure 3:
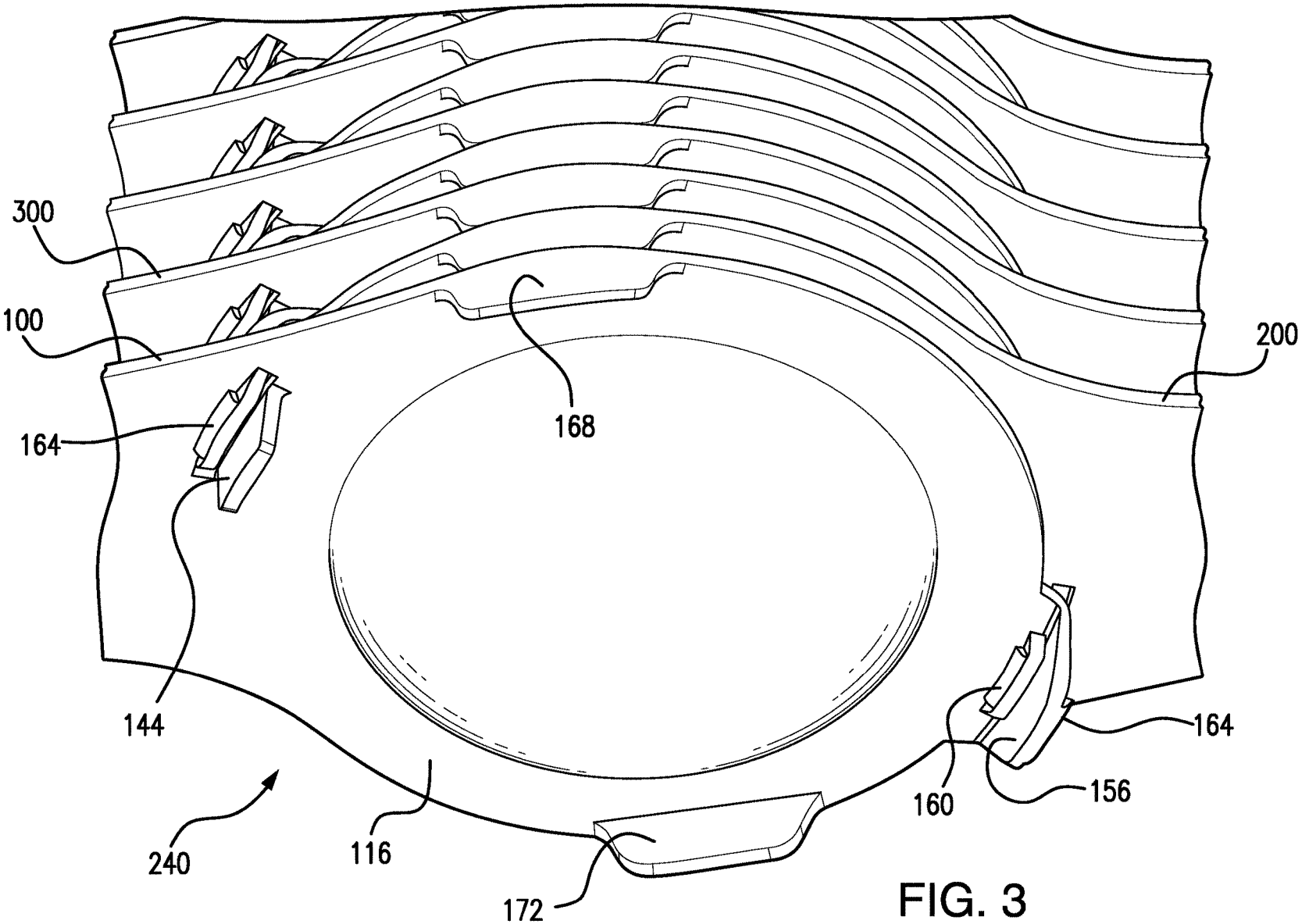
FIG. 3 is a bottom, side perspective view of the recyclable assembly shown in FIG. 2.

For a combination as described herein, each of the first contact lens package base member and the second contact lens package base member can comprise a poka-yoke design such that, for the first and second latches of the second contact lens package base member to extend through the second and first slots, respectively, of the first contact lens package base member, handle 112 of second contact lens package base member 200 extends in a direction opposite a direction of extension of handle 112 of first contact lens package base member 100. Such alternating directions of the handles are shown in FIGS. 2 and 3. FIG. 2 also shows a third used contact lens package base member 300 stacked on top of second used contact lens package base member 200. Features labeled in FIGS. 2-4 with the same reference numerals that appear in FIGS. 1A and 1B are intended to depict the same features as shown in FIGS. 1A and 1B.

Also provided is a plurality of contact lens packages, each contact lens package comprising a base member, a sealing member, and an unworn contact lens, for example, as depicted in FIG. 4. The base member can comprise, for example, base member 100 shown in FIGS. 1A and 1B. As shown in FIG. 4, the base member can define a cavity 128, can have a planar top surface 104 surrounding cavity 128, and can have at least one latch 156 with a first barb 160 and at least one slot (not shown in FIG. 4). Planar top surface 104 provides a sealing surface and the base member can comprise, for example, a thermoplastic material. The sealing member can comprise, as shown, a sealing member 404, and can be sealed or coupled to the sealing surface of the base member to provide a sealed cavity, as shown in the cross-sectional view of FIG. 4. An unworn contact lens 408 is provided in a contact lens packaging solution 412 within sealed cavity 128. The at least one latch of a first contact lens package of the plurality of contact lens packages is configured to fasten to the at least one slot of a second contact lens package of the plurality of contact lens packages. The fastening can occur after the sealing members are removed, at least from the bottom of the two contact lens packages. The at least one latch of the second contact lens package can be configured to fit into the at least one slot of the first contact lens package, and vice versa.

FIGS. 5A-5I show another embodiment of a blister package plastic base member 500 of the present invention. Blister package plastic base member 500 includes a double-barrel slot 547 and a single-barrel slot 548, for receiving one or more latches of another, stacked, blister package plastic base member. According to one or more embodiments of the present invention, the features shown in FIGS. 5A-5I, which correspond to features shown in FIGS. 1A-1B, are to be considered equivalent in form, function, shape, and dimension to the corresponding features shown and described with reference to FIGS. 1A-1B. Furthermore, according to one or more embodiments of the present invention, the features shown in FIGS. 1A-1B, which correspond to features shown in FIGS. 5A-5I, are to be considered equivalent in form, function, shape, and dimension to the corresponding features shown and described with reference to FIGS. 5A-5I.

FIGS. 5A-5I include reference numerals that refer to exemplary lengths, widths, heights, thickness, tapers, dimensions, angles, and radii-of-curvature, of blister package plastic base member 500. To the extent that contradiction is avoided, the exemplary lengths, widths, heights, thickness, tapers, dimensions, angles, and radii-of-curvature, of blister package plastic base member 500 shown in FIGS. 5A-5I can equally be used in the blister package plastic base member 100 shown in FIGS. 1A-1B.

Blister package plastic base member 500 includes a bowl 520, a double-barrel slot 547, a single-barrel slot 548, and a handle 512.

Figure 5A:
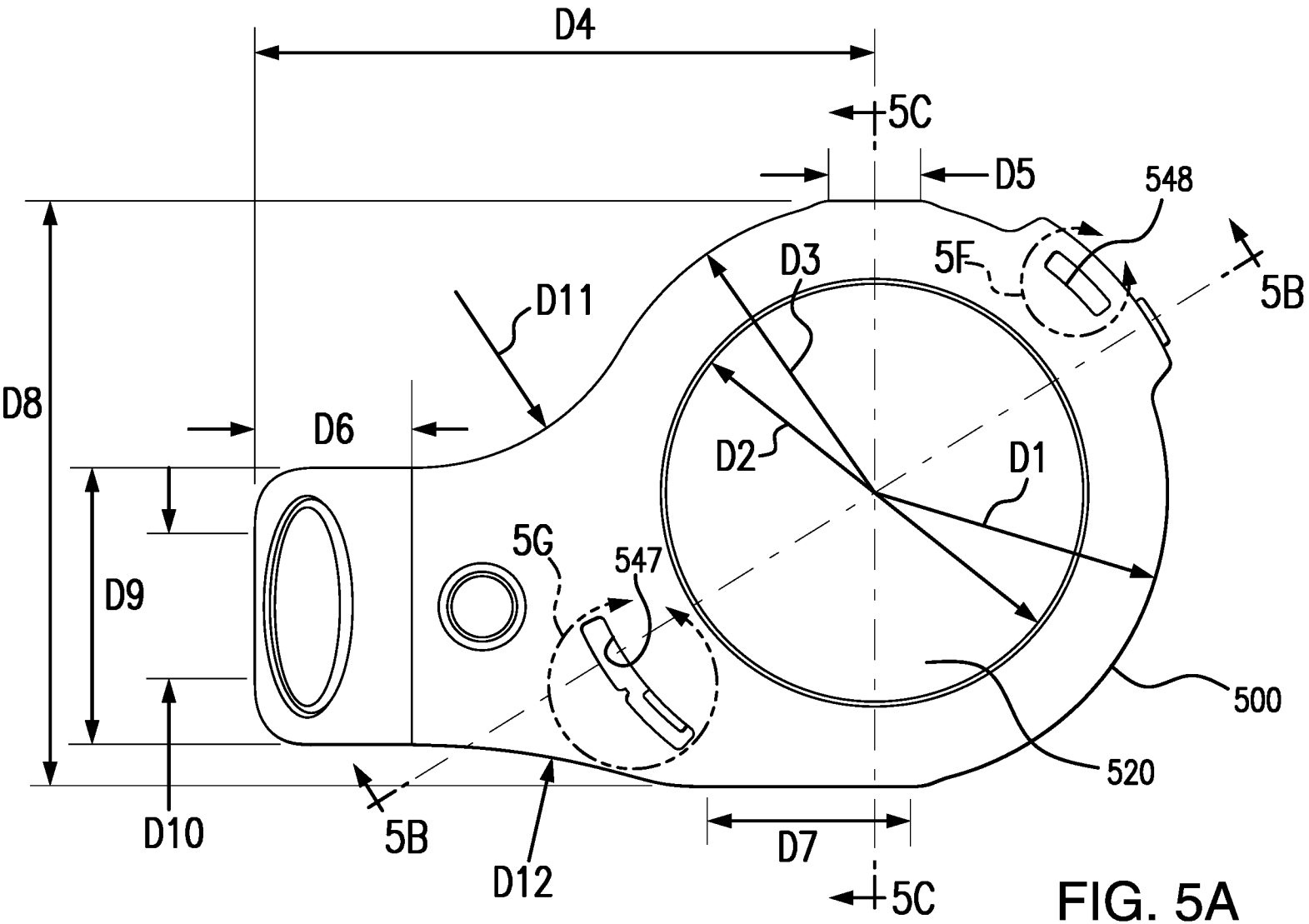
FIG. 5A is a top view of another embodiment of a blister package plastic base member according to the present invention.
Figure 5B:
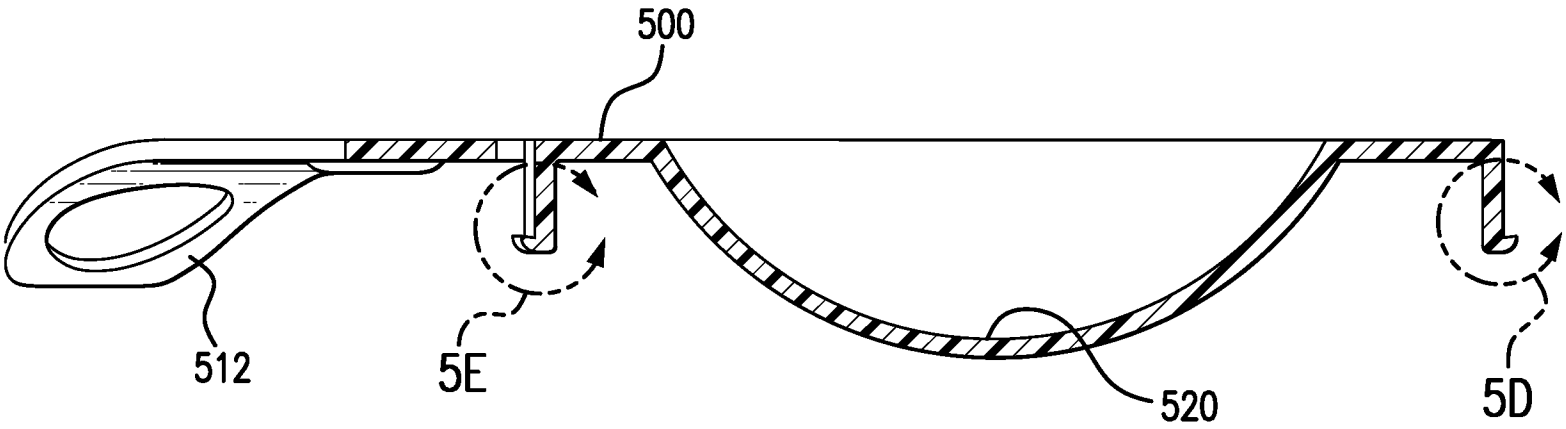
FIG. 5B is a side view, in partial cutaway, taken along line 5B-5B shown in FIG. 5A.

Referring to FIG. 5A, dimension D1 is the radius measured from the center of bowl 520 to the distal outer edge of blister package plastic base member 500. Radius D1 can be from 8 mm to 20 mm, from 10 mm to 18 mm, from 12 mm to 16 mm, or from 14 mm to 15 mm, for example, 14.5 mm.

Dimension D2 is the diameter of bowl 520. Diameter D2 can be from 12 mm to 30 mm, from 14 mm to 28 mm, from 16 mm to 26 mm, from 18 mm to 24 mm, or from 20 mm to 22 mm, for example, 21 mm or 21.18 mm.

Dimension D3 is the radius measured from the center of bowl 520 to the outer edge of blister package plastic base member 500, proximal to handle 512. Radius D3 can be from 8 mm to 20 mm, from 10 mm to 18 mm, from 12 mm to 16 mm, or from 14 mm to 15 mm, for example, 14 mm or 14.5 mm.

Dimension D4 is the length from the distal end of handle 512 to the center of bowl 520. Length D4 can be from 15 mm to 40 mm, from 18 mm to 37 mm, from 21 mm to 34 mm, or from 24 mm to 31 mm, for example, 31 mm or 30.8 mm.

Dimension D5 is the length of the straight portion pointed-out, along the outer edge on the inner side of blister package plastic base member 500. Length D5 can be from 1 mm to 8 mm, from 2 mm to 7 mm, from 3 mm to 6 mm, or from 4 mm to 5 mm, for example, 4 mm.

Dimension D6 is the length between the distal end of handle 512 to the proximal end of handle 512. Length D6 can be from 2 mm to 14 mm, from 3 mm to 13 mm, from 4 mm to 12 mm, from 5 mm to 11 mm, from 6 mm to 10 mm, or from 7 mm to 9 mm, for example, 8 mm or 7.84 mm.

Dimension D7 is the length of the straight portion pointed-out, along the outer edge of the outer side of blister package plastic base member 500. Length D7 can be from 5 mm to 15 mm, from 6 mm to 14 mm, from 7 mm to 13 mm, or from 8 mm to 12 mm, for example, 11 mm or 11.33 mm.

Dimension D8 is the length from the straight portion of the outer edge of the inner side to the straight portion of the outer edge of the outer side. Length D8 can be from 15 mm to 40 mm, from 18 mm to 37 mm, from 21 mm to 34 mm, or from 24 mm to 31 mm, for example, 29 mm.

Dimension D9 is the width of handle 512. Width D9 can be from 8 mm to 20 mm, from 9 mm to 19 mm, from 10 mm to 18 mm, from 11 mm to 17 mm, from 12 mm to 15 mm, or from 13 mm to 14 mm, for example, 14 mm or 13.73 mm.

Dimension D10 is the length between the opposing ends of the inner edge of the thumb grip of handle 512. Length D10 can be from 2 mm to 14 mm, from 3 mm to 13 mm, from 4 mm to 12 mm, from 5 mm to 11 mm, from 6 mm to 10 mm, or from 7 mm to 9 mm, for example, 7 mm or 7.28 mm.

D11 denotes the radius of curvature at the portion pointed-out, along the outer edge on the inner side proximal to handle 512. Radius of curvature D11 can be based on a radius of from 5 mm to 16 mm, from 6 mm to 15 mm, from 7 mm to 14 mm, or from 8 mm to 13 mm, for example, 12 mm or 12.09 mm.

D12 denotes the radius of curvature of the portion pointed-out, along the outer edge on the outer side proximal to handle 512. Radius of curvature D12 can be based on a radius from 30 mm to 50 mm, from 32 mm to 48 mm, or from 34 mm to 46 mm, for example, 40 mm.

Figure 5D:
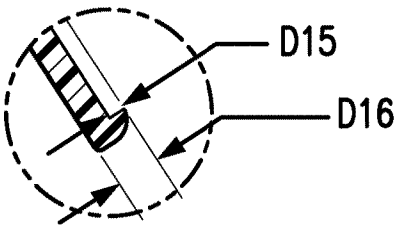
FIG. 5D is an enlarged view of section 5D shown in FIG. 5B.
Figure 5E:
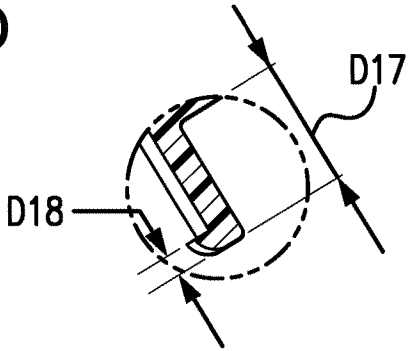
FIG. 5E is an enlarged view of section 5E shown in FIG. 5B.
Figure 5C:
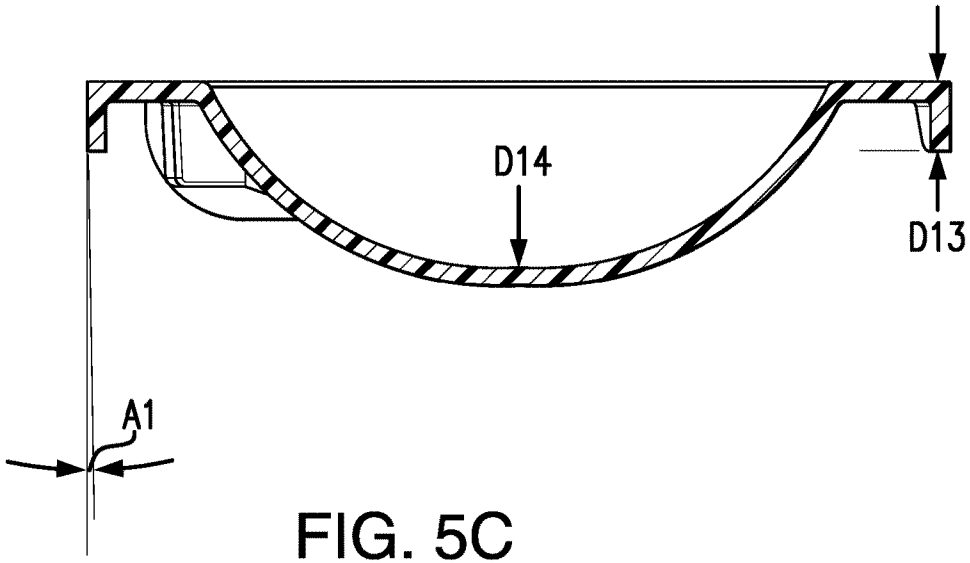
FIG. 5C is an end view, in partial cutaway, taken along line 5C-5C shown in FIG. 5A.

Referring to FIG. 5C, dimension D13 is the length of one of the vertical sidewalls. Length D13 can be from 1 mm to 5 mm, from 1.5 mm to 4.5 mm, or from 2 mm to 4 mm, for example, 2 mm or 2.3 mm.

D14 denotes a radius of curvature of bowl 520. Radius of curvature D14 can be based on a radius of from 10 mm to 30 mm, from 12 mm to 28 mm, from 14 mm to 26 mm, or from 16 mm to 24 mm, for example, 22 mm.

A1 is the angle between a vertical line and an outer wall of the vertical sidewall. Angle A1 can be provided to give a slight taper to the vertical sidewall. Angle A1 can be from 0.25° to 3°, from 0.5° to 2°, or 1°.

Referring to FIG. 5D, dimension D15 is the length from the distal end of the barb to the point where the barb intersects with the main body of the latch. Length D15 can be from 0.1 mm to 0.8 mm, from 0.2 mm to 0.7 mm, or from 0.3 mm to 0.6 mm, for example, 0.4 mm or 0.37 mm.

Dimension D16 is the length from the distal end of the barb to the opposing rear surface of the latch. Length D16 can be from 0.5 mm to 1.5 mm, from 0.6 mm to 1.4 mm, from 0.7 mm to 1.3 mm, from 0.8 to 1.2 mm, or from 0.9 mm to 1.1 mm, for example, 1 mm or 0.97 mm.

Referring to FIG. 5E, dimension D17 is the length of the latch. Length D17 can be from 1 mm to 5 mm, from 1.5 mm to 4.5 mm, or from 2 mm to 4 mm, for example, 3 mm or 2.9 mm.

Dimension D18 is the thickness of the barb. Thickness D18 can be from 0.1 mm to 1 mm, from 0.2 mm to 0.9 mm, from 0.3 mm to 0.8 mm, or from 0.4 mm to 0.7 mm, for example, 0.5 mm.

Figure 5G:
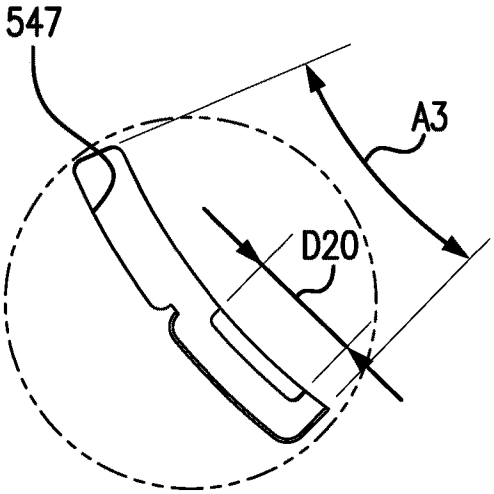
FIG. 5G is an enlarged view of section 5G shown in FIG. 5A.
Figure 5F:
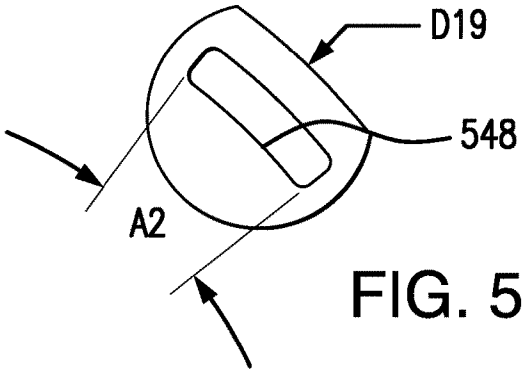
FIG. 5F is an enlarged view of section 5F shown in FIG. 5A.

Referring to FIG. 5F, A2 is the angle defined by opposing sides of slot 548, relative to the center of bowl 520. Angle A2 can be from 10° to 20°, from 12° to 18°, or from 14° to 16°, for example, 15°.

Dimension D19 is the radius from the center of bowl 520 to the distal outer edge of blister package plastic base member 500, adjacent to single-barrel slot 548. Radius D19 can be from 10 mm to 22 mm, from 12 mm to 20 mm, from 14 mm to 18 mm, or from 15 mm to 17 mm, for example, 16 mm.

Referring to FIG. 5G, A3 is the angle defined by opposing sides of double-barrel slot 547 relative to the center of bowl 520. Angle A3 can be from 12° to 30°, from 14° to 28°, or from 16° to 26°, for example, 22°.

Dimension D20 is the width of the latch extending downward and adjacent to one barrel of double-barrel slot 547. Width D20 can be from 1 mm to 5 mm, from 1.5 mm to 4.5 mm, or from 2 mm to 4 mm, for example, 3 mm or 2.6 mm.

Figure 5H:
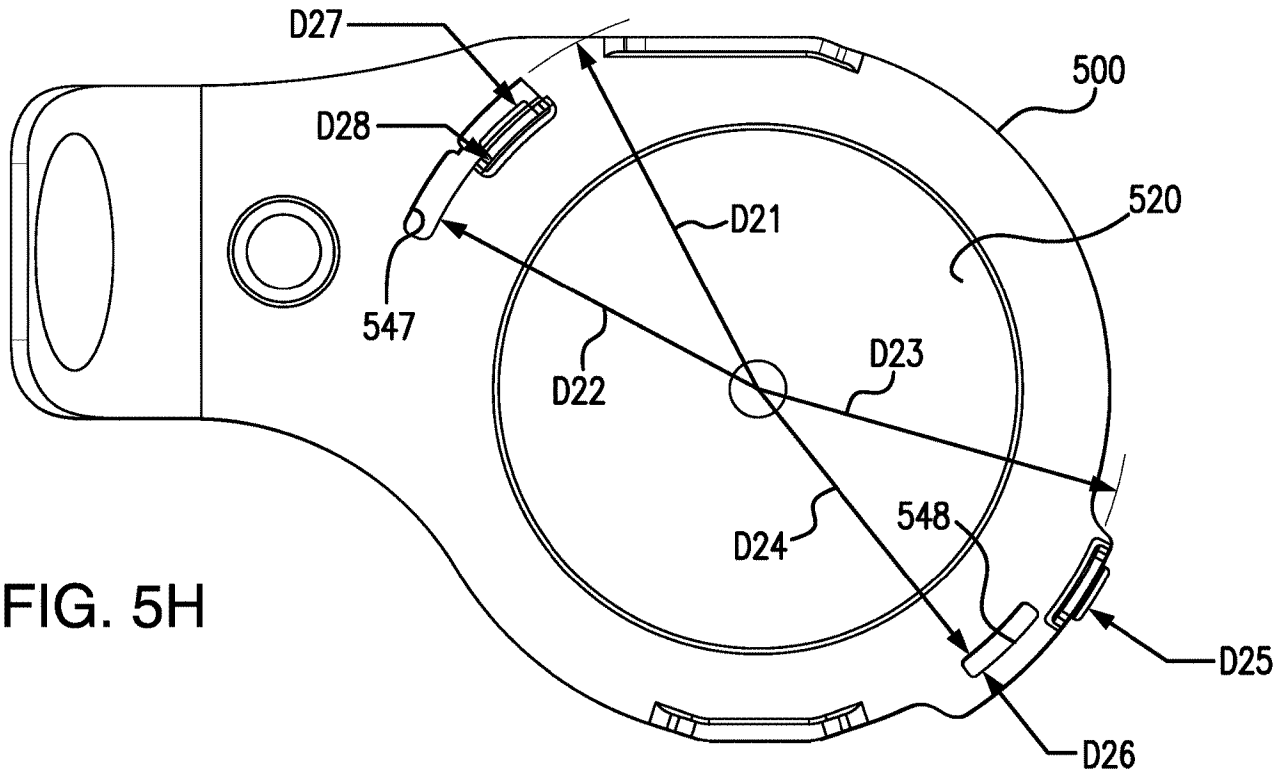
FIG. 5H is a bottom view of the blister package plastic base member shown in FIGS. 5A-5G.

Referring to FIG. 5H, dimension D21 is the radius measured from the center of bowl 520 to the proximal outer edge of blister package plastic base member 500, adjacent to double-barrel slot 547. Radius D21 can be from 8 mm to 22 mm, from 10 mm to 20 mm, from 12 mm to 18 mm, or from 14 mm to 17 mm, for example, 16 mm or 16.49 mm.

Dimension D22 is the radius measured from the center of bowl 520 to the inner edge of double-barrel slot 547. Radius D22 can be from 8 mm to 20 mm, from 10 mm to 18 mm, from 12 mm to 16 mm, or from 14 mm to 15 mm, for example, 15 mm or 14.89 mm.

A radius D23 is a radius from a center of bowl 520 to the latch that is adjacent slot 548. Radius D23 can be from 8 mm to 22 mm, from 10 mm to 20 mm, from 12 mm to 18 mm, or from 14 mm to 17 mm, for example, 15 mm or 15.43 mm.

Dimension D24 is the radius measured from the center of bowl 520 to the inner edge of single-barrel slot 548. Radius D24 can be from 8 mm to 20 mm, from 10 mm to 18 mm, or from 12 mm to 16 mm, for example, 14 mm.

Dimension D25 is the radius measured from the center of bowl 520 to the barb of the latch that is adjacent single-barrel slot 548. Radius D25 can be from 8 mm to 22 mm, from 10 mm to 20 mm, from 12 mm to 18 mm, or from 14 mm to 17 mm, for example, 16 mm or 16.4 mm.

Dimension D26 is the radius measured from the center of bowl 520 to the outer edge of single-barrel slot 548. Radius D26 can be from 8 mm to 20 mm, from 10 mm to 18 mm, or from 12 mm to 16 mm, for example, 15 mm.

D27 is the radius, that is, marks the end-point of the radius, measured from the center of bowl 520 to the barb of the latch adjacent to double-barrel slot 547. Radius D27 can be from 8 mm to 22 mm, from 10 mm to 20 mm, from 12 mm to 18 mm, or from 14 mm to 17 mm, for example, 16 mm or 15.7 mm.

Dimension D28 is the radius, that is, marks the end-point of the radius, measured from the center of bowl 520 to the inner side of the latch adjacent to double-barrel slot 547. Radius D28 can be from 8 mm to 20 mm, from 10 mm to 18 mm, or from 12 mm to 16 mm, for example, 15 mm or 14.7 mm.

Figure 5I:
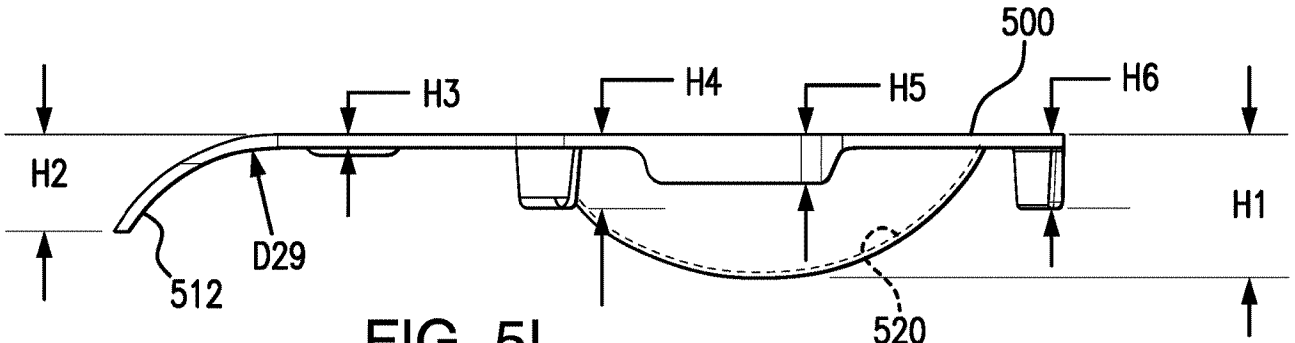
FIG. 5I is a side view of the blister package plastic base member shown in FIGS. 5A-5H.

Referring to FIG. 5I, D29 depicts the radius of curvature of the inside surface of handle 512. Radius of curvature D29 can be based on a radius of from 5 mm to 14 mm, from 6 mm to 13 mm, from 7 mm to 12 mm, or from 8 mm to 10 mm, for example, 8 mm or 8.4 mm.

Dimension H1 is the total height of blister package plastic base member 500, from its top surface to the bottom of bowl 520. Height H1 can be from 2 mm to 12 mm, from 3 mm to 11 mm, from 4 mm to 10 mm, from 5 mm to 9 mm, or from 6 mm to 8 mm, for example, 7 mm or 6.8 mm.

Dimension H2 is the height from the top surface of blister package plastic base member 500 to the bottom of handle 512. Height H2 can be from 1 mm to 10 mm, from 2 mm to 9 mm, from 3 mm to 8 mm, or from 4 mm to 7 mm, for example, 5 mm or 4.58 mm.

Dimension H3 is the thickness of the top surface of blister package plastic base member 500. Thickness H3 can be from 0.1 mm to 1.5 mm, from 0.2 mm to 1.3 mm, from 0.3 mm to 1.2 mm, from 0.4 to 1.2, or from 0.5 mm to 1 mm, for example, 0.6 mm.

Dimension H4 is the height from the top surface of blister package plastic base member 500 to the bottom of the latch adjacent double-barrel slot 547. Height H4 can be from 1 mm to 6 mm, from 2 mm to 5 mm, or from 3 mm to 4 mm, for example, 3.5 mm.

Dimension H5 is the height from the top surface of blister package plastic base member 500 to the bottom of the first vertical sidewall. Height H5 can be from 1 mm to 5 mm, from 1.5 mm to 4.5 mm, or from 2 mm to 4 mm, for example, 2 mm or 3 mm or 2.3 mm.

Dimension H6 is the height from the top surface of blister package plastic base member 500 to the bottom of the latch adjacent to single-barrel slot 548. Height H6 can be from 1 mm to 6 mm, from 2 mm to 5 mm, or from 3 mm to 4 mm, for example, 3.5 mm.

For any value provided for any dimension or size or angle or range, or other parameter herein, it is to be understood that these measurements or amounts or numbers can instead be a value that is plus or minus 1%, 5%, 10%, 15%, 20% or 25% from any one or more of the values provided.

A method of recycling a plurality of used contact lens package base members is also provided (e.g., an empty base member or a base member that has the seal member removed along with the lens and packaging solution removed). The method can comprise starting with or providing a plurality of used contact lens package base members. Each of the plurality of used contact lens package base members can independently define a cavity that is sized to retain a contact lens therein. Each of the plurality of used contact lens package base members can comprise a first latch, a second latch, a first slot, and a second slot, and each can comprise a thermoplastic material. The method of recycling involves stacking together the used contact lens package base members of the plurality such that the first latch and the second latch of one used contact lens package base member of the plurality are received within and mechanically fastened to the second and first slots, respectively, of another one of the used contact lens package base members. As a result, a stack is formed. Once enough base members are stacked together, the stack can be large enough to be a recyclable assembly. The recyclable assembly can then be recycled. As described herein, the first latch of each of the plurality of used contact lens package base members can comprise a protrusion or latch extending from the base member. The protrusion or latch can comprise a barb. The second slot of each of the plurality of empty contact lens package base members can comprise an opening or slot that receives the barb from a first direction and prevents the barb from exiting the opening or slot in a second direction opposite the first direction.

For forming a recyclable product and recycling, the first latch of each of the plurality of used contact lens package base members can be located on a first side of the respective used contact lens package base member. The second latch of each of the used contact lens package base members can be located on a second side of the used contact lens package base member. The second side can be the same as, different from, or opposite from, the first side.

For forming a recyclable product and recycling, the base member of each of the plurality of used contact lens package base members can comprise a handle extending laterally therefrom, and, in the stack or recyclable assembly, the handle of the first used contact lens package base member can extend in an opposite direction relative to a direction of extension of the handle of an adjacent, used, contact lens package base member. The first and second latches and the first and second slots of each of the used contact lens package base members of the plurality can, together, comprise a poka-yoke design such that the handle of a first used contact lens package base member extends in a different or opposing direction relative to the handle of one or two adjacent used contact lens package base members in the stack.

The present invention further includes a recyclable thermoplastic contact lens assembly. The assembly can be considered a recyclable plastic contact lens assembly, a recyclable thermoplastic assembly, or a recyclable assembly. In lieu of a thermoplastic material, any recyclable material can be used. The recyclable assembly includes a plurality of empty contact lens packages as described herein. In other words, the recyclable assembly includes a plurality of contact lens package base members without contact lenses or packaging solution. Each empty contact lens package comprises a base member having a cavity. The base member is as described herein, and the base member is a thermoplastic material (or other recyclable material) and has a substantially planar surface surrounding the cavity. The plurality of base members each have at least one slot and at least one latch that are attached to each other, as described herein (e.g., a latch of a first base member is connected with a slot of another base member). The base members that are attached together are empty (i.e., the sealing member has been opened or removed and the contact lens removed by the wearer or user.) If the sealing member is of the same recycle category as the base member, as an option, the sealing member can be attached as well to the base members.

As an option, the recyclable thermoplastic assembly can have at least an overall height of at least 2 inches (e.g., from 2 inches to 6 inches or more) and either or both of a width and depth of at least 2 inches (e.g., from 2 inches to 6 inches or more). These dimensions permit the assembly to be deposited into a recycling bin and be acceptable for recycling in a recycling facility.

As indicated, the unworn contact lens is sealed within the cavity of the sealed contact lens package and is packaged in a contact lens packaging solution. Any contact lens can be packaged therein. For example, the contact lens can be a hydrogel contact lens or it can be a silicone hydrogel contact lens. Examples of contact lenses that can be provided in the packages include those having the following United States Adopted Names (USANs): methafilcon A, ocufilcon A, ocufilcon B, ocufilcon C, ocufilcon D, omafilcon A, omafilcon B, comfilcon A, enfilcon A, stenfilcon A, fanfilcon A, etafilcon A, senofilcon A, senofilcon B, senofilcon C, narafilcon A, narafilcon B, balafilcon A, samfilcon A, lotrafilcon A, lotrafilcon B, somofilcon A, riofilcon A, delefilcon A, kalifilcon A, lehfilcon A, and the like. The contact lens packaging solution is typically a buffered saline solution, such as a phosphate buffered saline solution or a borate buffered saline solution, that may contain one or more additives, such as surfactants, wetting agents, viscosity agents, and the like.

The contact lens in the base member can be a soft contact lens, such as a soft silicone hydrogel contact lens.

The contact lens may be of any lens wear modality. Lens wear modality refers to the how many days and nights in a row the lens can be worn without removal. In one example, the contact lens is a daily disposable lens. Daily disposable lenses are indicated for single use, up to about 12 or 16 hours of continuous wear and should be discarded after the single use. In another example, the contact lens is a daily wear lens. Daily wear lenses are worn during the waking hours, typically up to about 12 to 16 hours, and are removed before sleep. Daily wear lenses are typically stored in a contact lens case containing a contact lens care solution for cleaning and disinfecting the lens during the hours of non-use. Daily wear lenses are typically discarded after a maximum of 30 days wear. In yet another example, the contact lens is an extended wear lens. Extended wear lenses are typically worn continuously for up to 6, 14 or 30 consecutive days and nights.

The packaging solution sealed within the contact lens package may be any conventional contact-lens compatible solution. In one example, the packaging solution comprises, consists, or consists essentially, of an aqueous solution of a buffer, and/or a tonicity agent. In another example, the packaging solution contains additional agents such as one or more additional antimicrobial agents, and/or a comfort agent, and/or a hydrophilic polymer, and/or a surfactant and/or other beneficial agent. In some examples, the packaging solution may comprise polysaccharides (e.g., hyaluronic acid, hydroxypropyl methylcellulose, hydroxypropyl cellulose, hydroxyethyl cellulose, etc.) or other high molecular weight polymers, such as polyvinyl pyrrolidone, which are commonly used as comfort polymers or thickening agents in ophthalmic solutions and contact lens packaging solutions. In other examples, the packaging solution may comprise an ophthalmic drug. The packaging solution can have a pH in the range of about 6.8 or 7.0 up to about 7.8 or 8.0. In one example, the packaging solution comprises phosphate buffer or borate buffer. In another example, the packaging solution comprises a tonicity agent selected from sodium chloride or sorbitol in an amount to maintain osmolality in the range of about 200 to 400 mOsm/kg, and typically from about 270 mOsm/kg up to about 310 mOsm/kg.

It will be appreciated that conventional manufacturing methods can be used to manufacture the sealed contact lens package. In a method of manufacturing a contact lens package, the method can include the step of placing an unworn contact lens and a contact lens packaging solution in a receptacle, placing a cover on the receptacle, and sealing the cover on the receptacle. Generally, the receptacle is configured to receive a single contact lens and an amount of packaging solution sufficient to completely cover the contact lens, typically about 0.5-1.5 ml. In one example, the receptacle comprises a plastic base member comprising a latch, a slot, a cavity configured to retain the contact lens and packaging solution and a flange region extending outwardly around the cavity, and the cover comprises a removable foil (or other sealing cover or lid) attached to the flange region to provide the sealed contact lens package. The removable foil (or other sealing cover or lid) may be sealed by any conventional means such as heat sealing or gluing. The method of manufacturing the sealed contact lens package may further comprise sterilizing the unworn contact lens by autoclaving the sealed contact lens package. The sealed package may be sterilized by sterilizing amounts of radiation, including heat or steam, such as by autoclaving, or by gamma radiation, e-beam radiation, ultraviolet radiation, etc. Autoclaving generally involves subjecting the sealed contact lens package to temperatures of at least 121° C. for at least 20 minutes.

With the present invention, it becomes possible to recycle used or opened contact lens packages as a collective unit such that the packages that form the collective unit preferably do not break or separate while being processed at a recycling facility. The collective unit is sufficiently dimensioned so as to be processed as recyclable material.

With the present invention, a person has an easy way to recycle used or opened contact lens packages.

With the present invention, a person has a simple yet efficient way to recycle used or opened contact lens packages, and by providing a simple way, this can encourage a person to actually recycle this material. For example, after removing the sealing member and contact lens from the base member, the base member can simply be pressed against another open base member such that the two are coupled together to form an assembly or stack that has a size, such as a volume or surface area that is greater than a single base member alone. Once enough base members are stacked, minimum size requirements can be met and a recyclable assembly is formed.

References herein to "an example" or "a specific example" or "an aspect" or "an embodiment" or similar phrase, are intended to introduce a feature or features of the invention, or components thereof, or methods thereof (depending on context) that can be combined with any combination of previously-described or subsequently-described examples, aspects, embodiments (i.e., features), unless a particular combination of features is mutually exclusive, or if context indicates otherwise. Further, as used in this specification, the singular forms "a," "an," and "the" include plural referents (e.g., at least one or more) unless the context clearly dictates otherwise. Thus, for example, reference to a "contact lens" includes a single lens as well as two or more of the same or different lenses.

The present invention includes the following aspects/embodiments/features in any order and/or in any combination:

1. The present invention relates to a contact lens package base member, comprising:
   - a planar top surface having an edge and at least partially defining a handle;
   - a bottom surface;
   - a bowl that is recessed from the planar top surface, has an upper rim that intersects with the planar top surface, and defines a cavity configured for holding a contact lens, the handle extending away from the bowl and terminating at a handle end;
   - a first slot formed through the planar top surface, spaced away from the upper rim, and located on a first side of the bowl;
   - a first latch extending downwardly from the planar top surface and adjacent to the first slot, the first latch being spaced away from the upper rim;
   - a second slot located on a second side of the bowl, the second side being opposite the first side; and
   - a second latch extending downwardly adjacent to the second slot.
2. The contact lens package base member or method or other embodiment of any preceding or following embodiment/feature/aspect, further comprising:
   - a sealing member coupled to the top planar surface and sealing the cavity; and
   - an unworn contact lens provided in a contact lens packaging solution within the sealed cavity.
3. The contact lens package base member or method or other embodiment of any preceding or following embodiment/feature/aspect, wherein the first latch comprises a first barb, and the second slot is sized to receive the first barb from a first direction, and catch the first barb, preventing it from exiting the second slot, in a second direction opposite the first direction.
4. The contact lens package base member or method or other embodiment of any preceding or following embodiment/feature/aspect, wherein the second latch comprises a second barb, and the first slot is sized to receive the second barb from the first direction, and catch the second barb, preventing it from exiting the first slot, in the second, opposite direction.
5. The contact lens package base member or method or other embodiment of any preceding or following embodiment/feature/aspect, wherein the first latch and the first slot are located between the bowl and the handle end.

6. The contact lens package base member or method or other embodiment of any preceding or following embodiment/feature/aspect, further comprising a first vertical sidewall and a second vertical sidewall, wherein:

the first vertical sidewall extends downwardly from the edge, has a first depth, and is located along the edge between the first latch and the second latch; and the second vertical sidewall extends downwardly from the edge, has a second depth, is located along the edge between the second latch and the first latch, and being located on an opposite side of the bowl relative to the first vertical sidewall.

7. The contact lens package base member or method or other embodiment of any preceding or following embodiment/feature/aspect, wherein the bowl has a depth of greater dimension than the first depth, and the bowl has a depth of greater dimension than the second depth.

8. The contact lens package base member or method or other embodiment of any preceding or following embodiment/feature/aspect, wherein the handle end curves downwardly from the planar top surface and comprises a thumb grip.

9. The contact lens package base member or method or other embodiment of any preceding or following embodiment/feature/aspect, further comprising a slotted extension bulging out from the edge, the slotted extension defining the second slot.

10. The contact lens package base member or method or other embodiment of any preceding or following embodiment/feature/aspect, wherein the second latch extends downwardly from the slotted extension.

11. The contact lens package base member or method or other embodiment of any preceding or following embodiment/feature/aspect, wherein the first latch is of a first latch dimension, the second latch is of a second, different corresponding latch dimension, the first slot is of a first slot dimension, and the second slot is of a second, different corresponding slot dimension.

12. The contact lens package base member or method or other embodiment of any preceding or following embodiment/feature/aspect, wherein each of the first latch and the second latch independently comprises a distal end, and each distal end has a tapered side, a tapered edge, a tapered corner, or a combination thereof.

13. In combination, the contact lens package base member or method or other embodiment of any preceding or following embodiment/feature/aspect, and a second contact lens package base member, the second contact lens package base member being independent from the first-mentioned contact lens package base member and comprising:

a planar top surface having an edge and at least partially defining a handle;

a bottom surface;

a bowl that is recessed from the planar top surface, has an upper rim that intersects with the planar top surface, and defines a cavity configured for holding a contact lens, the handle extending away from the bowl and terminating at a handle end;

a first slot formed through the planar top surface, spaced away from the upper rim, and located on a first side of the bowl;

a first latch extending downwardly from the planar top surface and adjacent to the first slot, the first latch being spaced away from the upper rim;

a second slot located on a second side of the bowl, the second side being opposite the first side; and a second latch extending downwardly and adjacent to the second slot, wherein the first latch of the second contact lens package base member is configured to fit into the second slot of the first contact lens package base member, and the second latch of the second contact lens package base member is configured to fit into the first slot of the first contact lens package base member.

14. The combination or method or other embodiment of any preceding or following embodiment/feature/aspect, wherein the second contact lens package base member is stacked on top of the first contact lens package base member to form a stack, and the first and second latches of the second contact lens package base member extend through the second and first slots of the first contact lens package base member, respectively.

15. The combination or method or other embodiment of any preceding or following embodiment/feature/aspect, wherein each of the first contact lens package base member and the second contact lens package base member comprises a poka-yoke design such that, for the first and second latches of the second contact lens package base member to extend through the second and first slots, respectively, of the first contact lens package base member, the handle of the second contact lens package base member extends in a direction opposite a direction of extension of the handle of the first contact lens package base member.

16. An embodiment that is a plurality of contact lens packages each comprising:

a base member that defines a cavity, the base member comprising a planar top surface surrounding the cavity, at least one latch, and at least one slot, wherein the planar top surface provides a sealing surface and the base member is a thermoplastic material;

a sealing member coupled to the sealing surface of the base member to provide a sealed cavity; and an unworn contact lens soaking in a contact lens packaging solution within the sealed cavity, wherein the at least one latch of a first contact lens package of the plurality of contact lens packages is configured to fasten to the at least one slot of a second contact lens package of the plurality of contact lens packages after the sealing member of at least the second contact lens package is removed.

17. The plurality of contact lens packages or method or other embodiment of any preceding or following embodiment/feature/aspect, wherein the at least one latch of each of the plurality of contact lens packages comprises a protrusion extending downwardly from the base member, the protrusion comprises a barb, and the at least one slot of each of the plurality of contact lens packages is sized to receive the barb from a first direction and prevent the barb from exiting the slot in a second direction opposite the first direction.

18. The plurality of contact lens packages or method or other embodiment of any preceding or following embodiment/feature/aspect, wherein the at least one latch of each of the plurality of contact lens packages comprises a first latch along a first side of the base member and a second latch along a second, opposite side of the base member, and the at least one slot of each of the plurality of contact lens packages comprises a first slot along the first side of the base member and a second slot along the second side of the base member.

19. The plurality of contact lens packages or method or other embodiment of any preceding or following embodiment/feature/aspect, wherein the base member of each of the plurality of contact lens packages further comprises a handle extending laterally therefrom.

20. The plurality of contact lens packages or method or other embodiment of any preceding or following embodiment/feature/aspect, wherein the at least one latch and the at least one slot of each of the plurality of contact lens packages together comprise a poka-yoke design such that the handle of the first contact lens package is only capable of extending in a direction opposite a direction of extension of the handle of the second contact lens package when the first contact lens package is mechanically fastened to the second contact lens package.

21. The plurality of contact lens packages or method or other embodiment of any preceding or following embodiment/feature/aspect, wherein the unworn contact lens of the first contact lens package is a right eye contact lens and the unworn contact lens of the second contact lens package is a left eye contact lens.

22. The plurality of contact lens packages or method or other embodiment of any preceding or following embodiment/feature/aspect, wherein the at least one latch of the first contact lens package has a distal end, and the distal end has a tapered side, a tapered edge, a tapered corner, or a combination thereof.

23. An embodiment that is a contact lens package comprising:

a base member made of a thermoplastic material, the base member defines a cavity and comprises a substantially planar surface surrounding a cavity, the substantially planar surface providing a sealing surface, the base member further comprising at least one latch and at least one slot;

a sealing member coupled to the sealing surface of the base member to provide a sealed cavity; and an unworn contact lens provided in a contact lens packaging solution within the sealed cavity, wherein the at least one latch is configured to mechanically fasten with a slot of another contact lens package and the at least one slot is configured to mechanically fasten to a latch of another contact lens package.

24. An embodiment that is a method of recycling a plurality of used contact lens package base members, the method comprising:

providing a plurality of used contact lens package base members, wherein each of the plurality of used contact lens package base members defines a cavity sized to retain a contact lens therein, a first latch, a second latch, a first slot, and a second slot, wherein each used contact lens package base member comprises a thermoplastic material;

stacking together the used contact lens package base members of the plurality such that the first latch and the second latch of one used contact lens package base member of the plurality are received within and mechanically fastened to the second and first slots, respectively, of another one of the used contact lens package base members, to form a recyclable assembly; and recycling the recyclable assembly.

25. The method or contact lens packages or other embodiment of any preceding or following embodiment/feature/aspect, wherein the first latch of each of the plurality of used contact lens package base members comprises a protrusion extending from the base member, the protrusion comprising a barb, and the second slot of each of the plurality of used contact lens package base members receives the barb from a first direction and prevents the barb from exiting the second slot in a second direction opposite the first direction.

26. The method or contact lens packages or other embodiment of any preceding or following embodiment/feature/aspect, wherein the first latch of each of the plurality of used contact lens package base members is located on a first side of the respective used contact lens package base member, and the second latch of each of the used contact lens package base members is located on a second side of the used contact lens package base member, the second side being opposite the first side.

27. The method or contact lens packages or other embodiment of any preceding or following embodiment/feature/aspect, wherein the base member of each of the plurality of used contact lens package base members further comprises a handle extending laterally therefrom, and, in the recyclable assembly, the handle of the first used contact lens package base member extends in an opposite direction relative to a direction of extension of the handle of an adjacent used contact lens package base member.

28. The method or contact lens packages or other embodiment of any preceding or following embodiment/feature/aspect, wherein the first and second latches and the first and second slots of the plurality of used contact lens package base members together comprise a poka-yoke design such that the handle of a first used contact lens package base member extends in an opposing direction relative to the handle of one or two adjacent used contact lens package base members in the recyclable assembly.

The present invention can include any combination of these various features or embodiments above and/or below as set forth in sentences and/or paragraphs. Any combination of disclosed features herein is considered part of the present invention and no limitation is intended with respect to combinable features.

The disclosure herein refers to certain illustrated examples, it is to be understood that these examples are presented by way of example and not by way of limitation. The intent of the foregoing detailed description, although discussing exemplary examples, is to be construed to cover all modifications, alternatives, and equivalents of the examples as may fall within the spirit and scope of the invention as defined by the additional disclosure.

The entire contents of all cited references in this disclosure, to the extent that they are not inconsistent with the present disclosure, are incorporated herein by reference.

The present invention can include any combination of the various features or embodiments described above and/or in the claims below as set forth in sentences and/or paragraphs. Any combination of disclosed features herein is considered part of the present invention and no limitation is intended with respect to combinable features.

Other embodiments of the present invention will be apparent to those skilled in the art from consideration of the present specification and practice of the present invention disclosed herein. It is intended that the present specification and examples be considered as exemplary only with a true scope and spirit of the invention being indicated by the following claims and equivalents thereof.

What is claimed is:

1. A plurality of contact lens packages each comprising:

a base member that defines a cavity, the base member comprising a planar top surface surrounding the cavity, at least one latch, and at least one slot, wherein the planar top surface provides a sealing surface and the base member is a thermoplastic material;

a sealing member coupled to the sealing surface of the base member to provide a sealed cavity; and an unworn contact lens in a contact lens packaging solution within the sealed cavity, wherein the at least one latch of a first contact lens package of the plurality of contact lens packages is configured to fasten to the at least one slot of a second contact lens package of the plurality of contact lens packages after the sealing member of at least the second contact lens package is removed.

2. The plurality of contact lens packages of claim 1, wherein the at least one latch of each of the plurality of contact lens packages comprises a protrusion extending downwardly from the base member, the protrusion comprises a barb, and the at least one slot of each of the plurality of contact lens packages is sized to receive the barb from a first direction and prevent the barb from exiting the slot in a second direction opposite the first direction.

3. The plurality of contact lens packages of claim 1, wherein the at least one latch of each of the plurality of contact lens packages comprises a first latch along a first side of the base member and a second latch along a second, opposite side of the base member, and the at least one slot of each of the plurality of contact lens packages comprises a first slot along the first side of the base member and a second slot along the second side of the base member.

4. The plurality of contact lens packages of claim 1, wherein the base member of each of the plurality of contact lens packages further comprises a handle extending laterally therefrom.

5. The plurality of contact lens packages of claim 4, wherein the at least one latch and the at least one slot of each of the plurality of contact lens packages together comprise a poka-yoke design such that the handle of the first contact lens package is only capable of extending in a direction opposite a direction of extension of the handle of the second contact lens package when the first contact lens package is mechanically fastened to the second contact lens package.

6. The plurality of contact lens packages of claim 1, wherein the unworn contact lens of the first contact lens package is a right eye contact lens and the unworn contact lens of the second contact lens package is a left eye contact lens.

7. The plurality of contact lens packages of claim 1, wherein the at least one latch of the first contact lens package has a distal end, and the distal end has a tapered side, a tapered edge, a tapered corner, or a combination thereof.

8. The plurality of contact lens packages of claim 3, wherein the second latch of each of the plurality of contact lens packages comprises a second barb, and the first slot of each of the plurality of contact lens packages is sized to receive the second barb from the first direction, and catch the second barb, preventing it from exiting the first slot, in the second, opposite direction.

9. The plurality of contact lens packages of claim 3, wherein for each of the plurality of contact lens packages, the first latch is of a first latch dimension, the second latch is of a second, different corresponding latch dimension, the first slot is of a first slot dimension, and the second slot is of a second, different corresponding slot dimension.

10. The plurality of contact lens packages of claim 3, wherein for each of the plurality of contact lens packages, each of the first latch and the second latch independently comprises a distal end, and each distal end has a tapered side, a tapered edge, a tapered corner, or a combination thereof.

* * * * *